United States Patent [19]

Nakashima

[11] Patent Number: 4,823,716

[45] Date of Patent: Apr. 25, 1989

[54] SEWING MACHINE WITH FABRIC-EDGE TRACING FUNCTION

[75] Inventor: Akifumi Nakashima, Ichinomiya, Japan

[73] Assignee: Brother Kogyo Kabushiki Kaisha, Japan

[21] Appl. No.: 124,834

[22] Filed: Nov. 24, 1987

[30] Foreign Application Priority Data

Nov. 26, 1986 [JP] Japan ..... 61-281466

[51] Int. Cl.[4] ..... D05B 3/02

[52] U.S. Cl. ..... 112/453; 112/153; 112/306

[58] Field of Search ..... 112/453, 456, 153, 457, 112/121.11, 306, 308, 443

[56] References Cited

U.S. PATENT DOCUMENTS 4,226,197 10/1980 Pollmeier et al. ..... 112/153 X
4,642,469 2/1987 Bretaudeau et al. ..... 250/561
4,664,048 5/1987 Naganuma et al. ..... 112/153 X

FOREIGN PATENT DOCUMENTS 62-68482 3/1987 Japan .
62-184873 11/1987 Japan .
62-189075 12/1987 Japan .
62-189076 12/1987 Japan .

*Primary Examiner*—Peter Nerbun
*Attorney, Agent, or Firm*—Parkhurst, Oliff & Berridge

[57] ABSTRACT

A sewing machine capable of forming a line of stitches along the edge of a workpiece, while the needle is reciprocated by a needle bar relative to the workpiece in a feeding movement. The needle bar is supported by an oscillator which is joggable in a lateral direction substantially perpendicular to the feeding direction. A sensor is provided to detect the fabric edge, by emitting a radiation toward a reflecting surface provided on the work bed of the machine. The sensor determines the position of the fabric edge by detecting an amount of the reflected radiation received. The reflecting surface has a concave shape in cross section taken in a vertical plane parallel to the feeding direction. The lateral jogging movement of the oscillator is controlled according to the amount of the reflected radiation received by the sensor, so that the line of stitches is spaced apart from the edge of the workpiece by a predetermined distance.

16 Claims, 9 Drawing Sheets

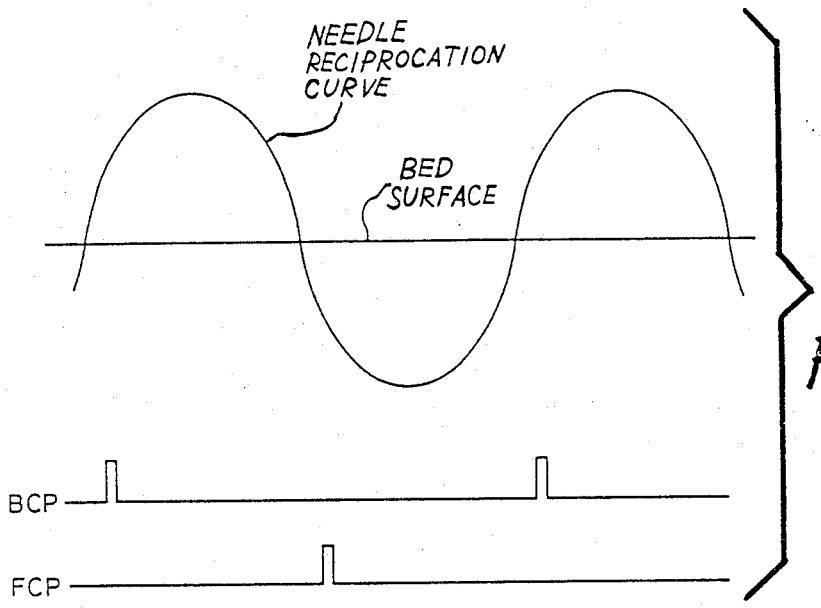
FIG.6
| STITCH NUMBER | 0 | 1 | 2 | 3 | 4 | 5 |
|---|---|---|---|---|---|---|
| NEEDLE POSITION COORDINATE | 0 | 15 | 0 | 15 | 0 | 15 |
FIG.7
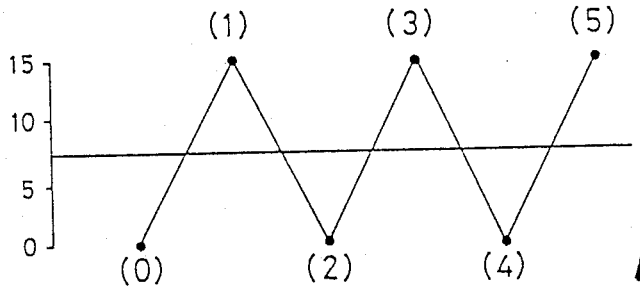
FIG.8

SEWING MACHINE WITH FABRIC-EDGE TRACING FUNCTION

BACKGROUND OF THE INVENTION

The present invention relates generally to a zigzag sewing machine, and more particularly to a sewing machine capable of forming a line of stitches a constant predetermined distance away from the edge of a work fabric (hereinafter referred to as "fabric edge").

A zigzag sewing machine is adapted to sew stitches in a zigzag fashion by laterally jogging a sewing needle. Such a zigzag sewing machine capable of changing the lateral position of the needle, i.e., the needle position in a direction perpendicular to a feeding direction of the work fabric, can be readily provided with a fabric-edge tracing function for forming stitches along the fabric edge, by adding simple devices such as a sensor for detecting the fabric edge.

In the sewing machine having the fabric-edge tracing function indicated above, however, the line of stitches formed cannot always exactly follow the fabric edge, and may sometimes suffer from a sharp bend, particularly where the work fabric does not have a distinctly defined straight or curved edge without unwoven threads or fibers. The unwoven threads or other projections from the fabric edge affect the output signal produced from the fabric-edge sensor, as if the fabric edge were displaced in the lateral jogging direction of the needle. In this case, the lateral position of the needle is changed according to the output signal which does not correctly reflect the position of the fabric edge. Such an erroneous detection of the fabric edge frequently occurs when the work fabric consists of thick fibers, as in the case of edge-trace sewing operations on jeans. A similar inconvenience may take place in other cases, for example, where the stitching operation is effected on a workpiece which bears tacking pins.

In the light of the above inconveniences, the assignee of the present application proposed a sewing machine having a fabric-edge tracing function as disclosed in Japanese Patent Application No. 60-209564. This sewing machine includes (a) a feed mechanism for feeding a workpiece, (b) a needle-bar oscillator which supports a needle bar having a sewing needle fixed to its lower end, such that the needle bar is endwise reciprocable, and which is supported by a machine frame such that the needle bar is laterally joggable in a lateral direction substantially perpendicular to a direction of feeding of the workpiece by the feed mechanism, (c) a fabric sensor having a light emitting portion and a light receiving portion for detecting the edge of the workpiece which extends in the feeding direction, (d) a reflecting surface disposed on a work bed of the machine, in the vicinity of a lowered position of the needle, for reflecting a radiation emitted by the light emitting portion, toward the light receiving portion, (e) bight-signal generator means for generating a bight signal representative of a distance from the edge of the workpiece, according a detection signal from the fabric sensor, and (f) a bight control device responsive to the bight signal, for controlling an amount of lateral jogging of the needle. In this sewing machine, the needle position is displaced by the bight signal generated from the bight-signal generator means, at least when the amount of variation in the edge position of the workpiece between the moments of formation of two successive stitches by endwise reciprocating movements of the needle exceeds a predetermined value. The amount of displacement of the needle position is smaller than the amount of variation in the edge position of the workpiece. According to this proposed arrangement, the needle position is not so sensitively changed due to the presence of unwoven fibers or other projections from the fabric edge, whereby a conventionally experienced sharp bend of the stitching line can be avoided.

SUMMARY OF THE INVENTION

It is an object of the present invention to provide a sewing machine having a fabric-edge tracing function, which includes means other than those proposed in the above-identified document, for assuring a beautiful line of stitches following the edge of a workpiece, even if the workpiece has unwoven fibers at its edge or bears tacking pins.

The above object may be achieved according to the principle of the present invention, which provides a sewing machine having a function of tracing an edge of a workpiece to form a line of stitches along the edge, comprising (a) a machine frame; (b) a work bed on which the workpiece is placed; (c) an endwise reciprocable needle bar which has a sewing needle fixed at its lower end; (d) a feed mechanism for feeding the workpiece in a predetermined feeding direction; (e) a needle-bar oscillator for supporting the needle; (f) a fabric sensor for detecting the edge of the workpiece which extends in the feeding direction; (g) a smooth reflecting surface provided on the work bed, in the vicinity of a lowered position of the needle; and (h) actuator and control means responsive to the fabric sensor, for effecting a controlled jogging movement of the needle-bar oscillator in the lateral direction.

The needle-bar oscillator is adapted to support the needle bar such that the needle bar is endwise reciprocable with the needle. The oscillator is disposed on the machine frame, such that the oscillator is joggable in a lateral direction substantially perpendicular to the feeding direction of the workpiece. The fabric sensor includes a light emitting portion for emitting a radiation toward the reflecting surface, and a light receiving portion for receiving the reflected radiation.

The reflecting surface has a concave shape in cross section taken in a vertical plane parallel to the feeding direction The actuator and control means is operated according to an amount of the radiation received by the light receiving portion of the fabric sensor, to control the lateral movement of the needle-bar oscillator, so that the line of stitches is spaced apart from the edge of the workpiece by a predetermined distance.

In the sewing machine of the present invention constructed as described above, the reflecting surface has a sufficient smoothness and a concave cross sectional shape as viewed in the vertical plane parallel to the feeding direction of the workpiece. The concavity of the reflecting surface permits the light receiving portion of the fabric sensor to receive the radiation which is reflected by a comparatively large area on the reflecting surface, as viewed in the feeding direction. In other words, the length of detection of the workpiece edge by the fabric sensor in the feeding direction is larger in the instant sewing machine than in a conventional arrangement which uses a flat straight reflecting surface. Accordingly, unwoven fibers or other projections from the workpiece edge will have a reduced influence on the output signal of the fabric sensor. If the detecting length of the fabric sensor is comparatively small, the unwoven fibers which do not define the workpiece edge occupy a comparatively large percent of the detection area, causing a comparatively large change in the amount of the reflected radiation received by the sensor, due to the presence of the unwoven fibers. This means a larger detection error of the sensor, and consequently a sharper bend of the stitching line, than in the case where the detecting length of the sensor is comparatively large. Therefore, the fabric sensor and the smooth concave reflecting surface of the instant sewing machine assure a reduced error of detection of the workpiece edge due to the presence of the unwoven fibers or other projections from the edge, and permit a reduced angular deviation of the stitching line with respect to the edge of the workpiece. Namely, the stitches can be formed more exactly along the workpiece edge, with a predetermined constant spacing between the stitching line and the workpiece edge.

According to one feature of the invention, the fabric sensor engages the needle-bar oscillator such that the fabric sensor is moved in relation to the controlled lateral movement of the needle-bar oscillator, and the actuator and control means includes a guide member for guiding the fabric sensor. The guide member is fixed to the machine frame so as to extend substantially in the lateral direction. According to this feature of the invention, the needle-bar oscillator may be adapted to be pivoted about a vertical axis, so as to provide a lateral jogging motion of the needle bar. In this case, it is preferred that the reflecting surface is defined by a part of a cylinder whose centerline extends substantially in the lateral direction.

According to another feature of the invention, the needle-bar oscillator is pivotable substantially about a straight line which extends substantially in the feeding direction of the workpiece, and the fabric sensor is supported by the thus arranged needle-bar oscillator so that the sensor is moved with the oscillator. In this case, it is preferable that the reflecting surface is defined by a part of an outer surface of a torus having a center on the straight line indicated above. The reflecting surface therefore has an arcuate shape in cross section taken in the vertical plane parallel to the feeding direction and in a vertical plane parallel to the lateral direction of the needle.

According to a further feature of the invention, the fabric sensor is secured to the machine frame. In this case, the reflecting surface is preferably defined by a part-spherical surface, irrespective of whether the axis about which the needle-bar oscillator is pivoted extends vertically or horizontally.

According to a still further feature of the invention, the actuator and control means comprises first positioning means and second positioning means. The first positioning means is adapted to change a relative position between the needle-bar oscillator and the fabric sensor, so as to establish a selected relative position between the fabric sensor and the needle in the lateral direction. The second positioning means is adapted to position the needle-bar oscillator and the fabric sensor in response to a variation in the position of the edge of the workpiece in the lateral direction, While maintaining the relative position between the oscillator and the sensor, so that the amount of the radiation received by the light receiving portion of the fabric sensor is maintained at a predetermined value.

In one form of the above feature of the invention, the actuator and control means further comprises: a first guide member supported by the machine frame and extending substantially in the lateral direction; a first slide slidably supported by the first guide member, and engaging the needle-bar oscillator such that the first slide is moved as the needle-bar oscillator is laterally jogged; a second guide member supported by the first slide and extending substantially in the lateral direction; a second slide slidably supported by the second guide member, and supporting the fabric sensor; and actuator means for changing a position of the second slide relative to the first slide. The actuator means may include a feed screw which is rotatably and axially immovably supported by the first slide and threaded to the second slide, and an electric drive motor for rotating the feed screw. In this case, detector means may be provided to detect an amount of rotation of the feed screw and thereby detecting a position of the fabric sensor relative to the first slide.

The object of the present invention may be achieved according to another aspect of the invention, which provides a sewing machine having a function of tracing an edge of a workpiece to form a line of stitches along the edge, comprising: (a) a machine frame; (b) a work bed on which the workpiece is placed; (c) an endwise reciprocable needle bar which has a sewing needle fixed at its lower end; (d) a feed mechanism for feeding the workpiece in a predetermined feeding direction; (e) a needle-bar oscillator for supporting the needle bar such that the needle bar is endwise reciprocable with the needle, the needle-bar oscillator being disposed on the machine frame, such that the oscillator is joggable in a lateral direction substantially perpendicular to the feeding direction of the workpiece; (f) a fabric sensor for detecting the edge of the workpiece which extends in the feeding direction, the fabric sensor including a light emitting portion for producing a radiation, and a light receiving portion; (g) a smooth reflecting surface provided on the work bed, in the vicinity of a lowered position of the needle, for reflecting the radiation toward the light receiving portion of the fabric sensor; and (h) actuator and control means responsive to the fabric sensor, for effecting a controlled jogging movement of the needle-bar oscillator in the lateral direction, according to an amount of the radiation received by the light receiving portion of the fabric sensor, so that the line of stitches is spaced apart from the edge of the workpiece by a predetermined distance. The fabric sensor engages the needle-bar oscillator such that the fabric sensor is moved in relation to the controlled lateral movement of the needle-bar oscillator. The actuator and control means includes a guide member for guiding the fabric sensor. The guide member is fixed to the machine frame so as to extend substantially in the lateral direction.

In the sewing machine described just above, the guide member fixed to the machine frame permits the fabric sensor to be moved in the lateral direction of the needle when the needle-bar oscillator is jogged in the lateral direction. That is, the fabric sensor is not displaced in the fabric feeding direction even when the sensor is moved while being supported by the guide member. Therefore, the instant sewing machine does not suffer from otherwise possible detecting error of the sensor due to dislocation of the sensor in the fabric feeding direction.

According to one feature of the above aspect of the invention, the actuator and control means comprises first positioning means for changing a relative position between the needle-bar oscillator and the fabric sensor, so as to establish a selected relative position between the fabric sensor and the needle in the lateral direction, and further comprises second positioning means for positioning the needle-bar oscillator and the fabric sensor in response to a variation in the position of the edge of the workpiece in the lateral direction, while maintaining the relative position between the oscillator and the sensor so that the amount of the radiation received by the light receiving portion of the fabric sensor is maintained at a predetermined value.

In one form of the above feature of the invention, the actuator and control means further comprises: a first slide slidably supported by the guide member, and engaging the needle-bar oscillator such that the first slide is moved as the needle-bar oscillator is laterally jogged; another guide member supported by the first slide and extending substantially in the lateral direction; a second slide slidably supported by the another guide member, and supporting the fabric sensor; and actuator means for changing a position of the second slide relative to the first slide.

BRIEF DESCRIPTION OF THE DRAWINGS

The foregoing and optional objects, features and advantages of the present invention will be better understood by reading the following detailed description of presently preferred embodiments of the invention, when considered in connection with the accompanying drawings, in which:

FIG. 6 is a timing chart indicating a relationship between a reciprocating movement of a sewing needle, and generation of timing pulses;

FIG. 7 is a view showing a relationship between zigzag stitch numbers and needle position coordinates;

FIG. 8 is an illustration showing a pattern of zigzag stitches;

DETAILED DESCRIPTION OF THE PREFERRED EMBODIMENT

Figure 1:
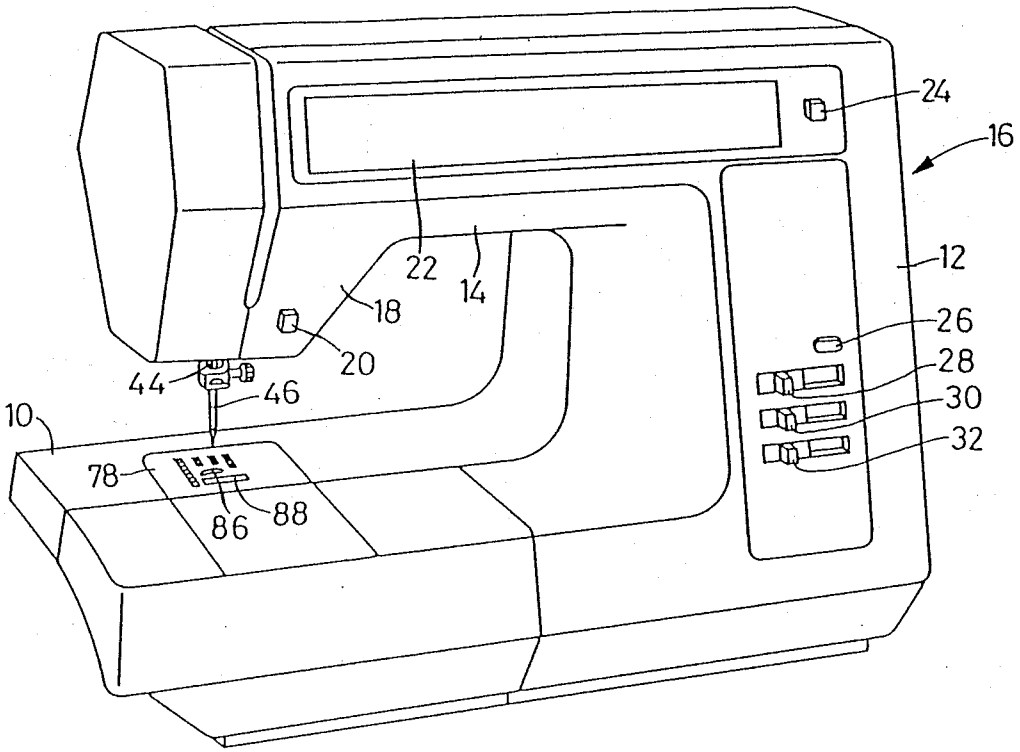
FIG. 1 is a schematic perspective view of one embodiment of an edge-tracing sewing machine of the invention, showing the exterior appearance of the sewing machine.
Figure 2:
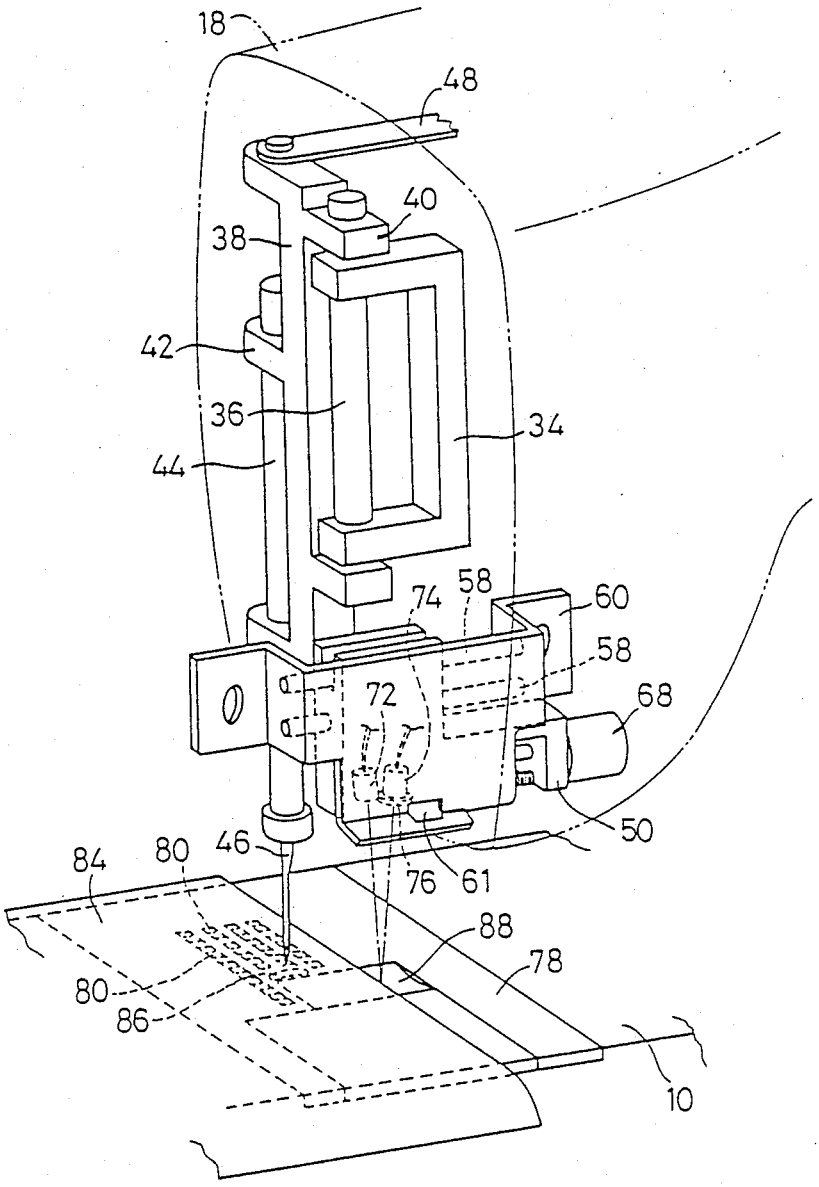
FIG. 2 is a perspective view of a head portion of the sewing machine of FIG. 1, with a head cover thereof removed to show the interior construction of the head portion.

Referring first to FIG. 1, there is shown a sewing machine which includes a work bed 10 having a flat upper surface, a standard 12 rising from the right-hand side end (as viewed in the figure) of the bed 10, a bracket arm 14 extending from the upper end of the standard 12 substantially in parallel with the bed 10, and a head 18 provided t the free end of the bracket arm 14. These members 10, 12, 14 and 18 are incorporated in a frame generally indicated at 16. The head 18 has a main switch 20 for turning on and off the sewing machine. The bracket arm 14 has a display panel 22 on which there are provided a plurality of indicia indicative of stitch patterns available on the instant sewing machine. The bracket arm 14 further has a pattern select switch 24 for selecting the stitch patterns. On the standard 12, there is provided a tracing-mode select switch 26 used to place the sewing machine in a tracing-mode in which a line of stitches are formed a predetermined constant distance away from the edge of a workpiece or work fabric 84 (FIG. 2). There are also provided on the standard 12: a width setting member 28 for setting a spacing or width (hereinafter referred to as "stitch width") between the edge of the work fabric and the line of stitches; a bight adjusting member 30; and a feed adjusting member 32.

Referring next to FIG. 2 showing the interior construction of the head 18 as seen with its covering member removed, a generally U-shaped bracket 34 is fixedly provided i the head 18. The bracket 34 has a vertically extending shaft 36 which supports a needle-bar oscillator 38 pivotally about a vertical axis. Described more specifically, the oscillator 38 has two pairs of arms 40, 42 which project in opposite directions. The arms 40 of the one pair engage the shaft 36 of the bracket 34, while the arms 42 of the other pair engage a needle bar 44 such that the needle bar 44 is slidable in the vertical direction. The needle bar 44 is adapted to carry a needle 46 at its lower end, and is connected to a needle drive motor (not shown) via a linkage (not shown), so that the needle bar 44 and the needle 46 are endwise reciprocated in the vertical direction during the activation of the needle drive motor. The needle-bar oscillator 38 is operatively connected via a link 48 to a bight control motor 124 (which will be described). With this bight control motor 124 operated, the needle-bar oscillator 38 is pivoted about the shaft 36, whereby the needle 46 is laterally jogged in a plane parallel to the upper surface of the bed 10, along an arcuate path defined by an arc of a circle whose center lies on the axis of the shaft 36. Since the radius of this circle is relatively large, the arcuate path taken by the needle 46 is almost perpendicular to a direction in which the work fabric 84 is fed by a feeding mechanism which will be described. Thus, the position of the needle 46 in the lateral direction with respect to the fabric feeding direction can be varied within a predetermined range.

Figure 3:
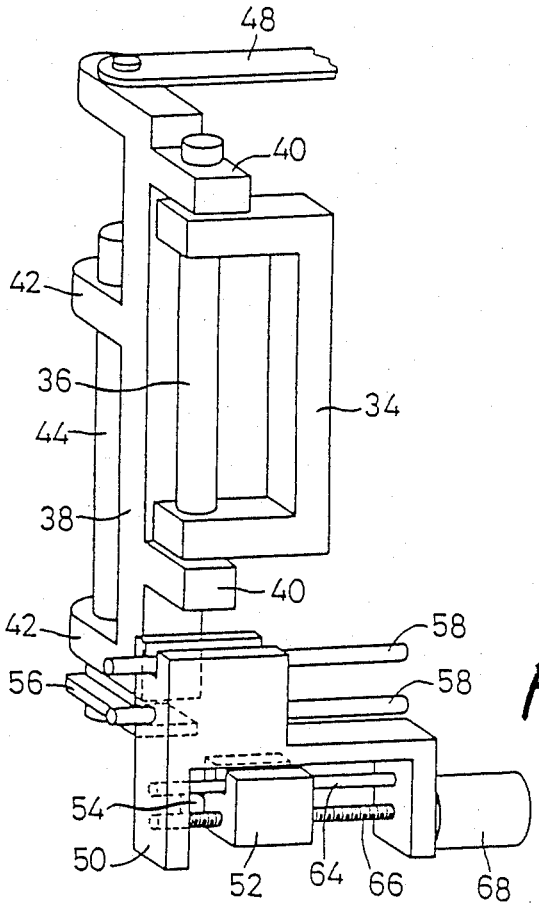
FIG. 3 is a perspective view of a mechanism for moving a fabric sensor used in the sewing machine.

On the lower end of the needle-bar oscillator 38, there is mounted a fabric sensor 54 via a first slide 50 and a second slide 52, as shown in FIG. 3. The first slide 50 has a yoke 56 which extends toward the oscillator 38 so that the yoke 56 engages the lower end of the oscillator 38. The first slide 50 is slidably supported by a guide member in the form of a pair of parallel guide rods 58, 58, which are supported by a support member 60 (FIG. 2) secured to the frame 16. The guide rods 58, 58 extend in the lateral direction of the needle 46 indicated above. According to this arrangement, a pivotal movement of the needle-bar oscillator 38 will cause a movement of the first slide 50 in the lateral direction while being supported by the guide rods 58, which in turn causes movements of the second slide 52 and the sensor 54 in the lateral direction. Reference numeral 61 in FIG. 2 designates a thread guide provided on the support member 60.

The sensor 54 is secured to the second slide 52. To support the second slide 52, a guide rod 64 and a feed screw 66 which are parallel to the guide rods 58, 58 are supported at their opposite ends by the first slide 50. The guide rod 64 extends through the second slide 52 while the feed screw 66 is threaded to the second slide 52. The feed screw 66 is connected to a sensor-positioning motor in the form of a bidirectionally operable dc motor 68. With the sensor-positioning dc motor 68 operated, the feed screw 66 is rotated, and the second slide 52 is moved while being guided by the guide rod 64. Thus, the position of the sensor 54 with respect to the oscillator 38 in the lateral direction of the needle 46 can be varied by the sensor-positioning motor 68. This motor 68 incorporates a position detector 70 (FIG. 5) for detecting the lateral position of the second slide 52.

Referring back to FIG. 2, the sensor 54 includes a light emitter 72 which emits a radiation such as infrared rays, and a photoelectric cell 74 which receives the reflected infrared rays as described later. In the vicinity of the photoelectric cell 74 is disposed an optical filter 76 which permits the infrared rays to pass therethrough, but blocks light rays of the other wavelength bands.

Figure 4:
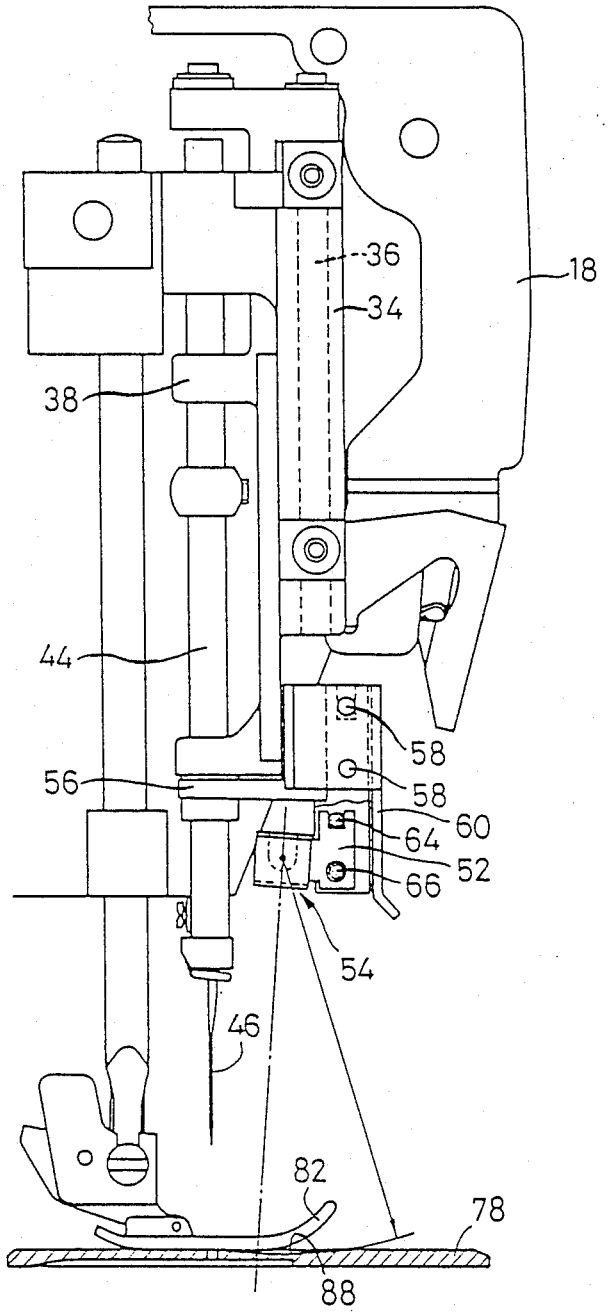
FIG. 4 is a side elevational view of the head portion of the sewing machine, with its head cover removed.

The upper surface of the bed 10 previously indicated has an aperture closed by a throat plate 78. This throat plate 78 has a plurality of slots, through which respective feed dogs 80 are adapted to protrude above the throat plate 78. The feed dogs 80 are given feeding movements by a feed control motor 122 (which will be described), and cooperate with a presser foot 82 as shown in FIG. 4, to feed the work fabric 84 in the feed direction perpendicular to the direction of lateral jogging of the needle 46. The feed dogs 80, presser foot 82, feed control motor 122, etc. constitute a feed mechanism for feeding the work fabric 84. The feeding direction is substantially perpendicular to the direction of lateral jogging or pivotal movement of the needle-bar oscillator 38.

The throat plate 78 further has an elongate needle hole 86 (FIGS. 1 and 2) which is formed along the arcuate path taken by the needle 46. That is, the elongate needle hole 86 is substantially perpendicular to the feed direction of the work fabric 84. In the vicinity of the needle hole 86, a smooth concave reflecting surface 88 is provided on the throat plate 78, such that the length of the surface 88 is parallel to the needle hole 86. The reflecting surface 88 reflects the infrared rays emitted by the light emitter 72 of the sensor 54, so that the reflected rays are received by the photoelectric cell 74, as previously indicated. The reflecting surface 88 is formed as a part of the circumferential surface of a cylinder whose centerline extends horizontally in the previously identified lateral direction of the needle 46 substantially perpendicular to the fabric feeding direction and passes the sensor 54. Thus, the reflecting surface 88 has a concave shape as shown in FIG. 4, which is defined by the convexity of the above-indicated part of the circumferential surface of the above cylinder, when viewed in cross section of the cylinder taken in a vertical plane parallel to the feeding direction of the work fabric 84 and the direction of reciprocation of the needle bar 44.

The sensor 54 is adapted to detect an amount of the infrared rays which are reflected by a preset detection area on the reflector surface 88. The amount of light received by the photoelectric cell 74 decreases as the surface area of the detection area covered by the work fabric 84 increases, so that the photoelectric cell 74 generates a detection signal which corresponds to the surface area of the detection area which is not covered by the work fabric 84. While the reflector surface 88 is provided close to the needle hole 86, the sensor 54 is spaced from the needle hole 86 toward the front of the machine (toward the operator's side, or to the right as viewed in FIG. 4) by a given distance, in order to avoid an interference with the needle-bar oscillator 38. Further, the optical plane of the sensor 54 is inclined by a small angle relative to the vertical plane, as indicated in Fig. 4, so that the optical plane of the sensor 54 intersects the upper surface of the throat plate 78, at a point close to an intersection between the centerline of the needle 46 and the upper surface of the throat plate 78. The above intersection is hereinafter referred to as "lowered position" of the needle 46. In other words, the sensor 54 is adapted to detect the amount of light reflected by the detection area which is close to the lowered position of the needle 46 in the fabric feeding direction.

Figure 5:
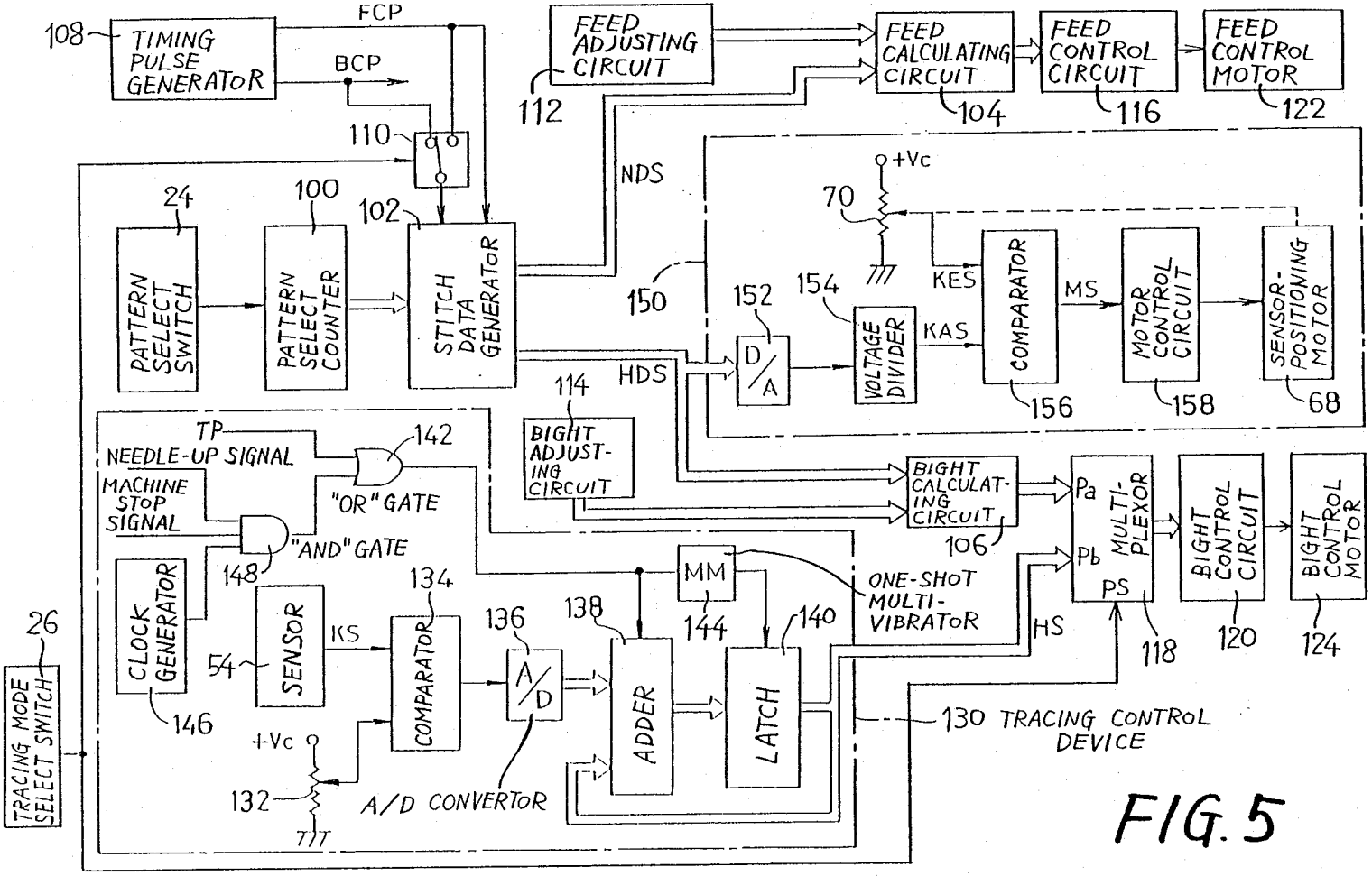
FIG. 5 is a block schematic diagram of a control system of the sewing machine.

Referring to the block diagram of FIG. 5, there is shown a control system of the present sewing machine. Although the control system illustrated in FIG. 5 by way of example only takes the form of a discrete circuit, the major part of the control system may be constituted by a microcomputer. The pattern select switch 24 is indicated at the left-hand side end of the block diagram. To this select switch 24, there is connected a pattern select counter 100 which counts the number of operation of the select switch 24. A signal representative of the count of the pattern select counter 100 is applied to a stitch data generator 102. According to the varying count of the counter 100, the corresponding one of light emitting diodes incorporated in the display panel 22 is turned on to indicate the currently selected stitch pattern.

The stitch data generator 102 stores a set of stitch data representative of each stitch pattern that can be formed in the instant sewing machine. The stitch data generator 102 supplies a feed calculating circuit 104 and a bight calculating circuit 106 with a set of stitch data which corresponds to the current count of the pattern select counter 100. Described more specifically, the stitch data generator 102 receives via an analog switch 110 timing pulses which are generated by a timing pulse generator 108 each time the needle bar 44 is reciprocated. Namely, the timing pulse generator 108 generates a first timing pulse BCP and a second timing pulse FCP, in timed relation with each reciprocating of the needle 46, as indicated in Fig. 6. Each time the first timing pulse BCP is generated by the generator 108, the stitch data generator 102 applies bight data HDS of the stitch data to the bight calculating circuit 106. Similarly, the stitch data generator 102 applies feed data NDS of the stitch data to the feed calculating circuit 104 each time the second timing pulse FCP is generated by the timing pulse generator 108.

A feed adjusting circuit 112 is connected to the feed calculating circuit 104, while a bight adjusting circuit 114 is connected to the bight calculating circuit 106. The feed adjusting circuit 112 supplies the feed calculating circuit 104 with feed adjusting data which is variable by the feed adjusting member 32. The feed calculating circuit 104 multiplies the feed data NDS from the stitch data generator 102 by the feed adjusting data from the feed adjusting circuit 112, and a product obtained by the multiplication is fed to a feed control circuit 116, whereby the feed data NDS of the stitch data stored in the generator 102 for the selected stitch pattern is adjusted according to the current position of the feed adjusting member 32. Similarly, the bight calculating circuit 106 is adapted to adjust the bight data HDS from the stitch data generator 102, according to bight adjusting data from the bight adjusting circuit 114, which corresponds to the current position of the bight adjusting member 30. The bight data adjusted by the calculating circuit 106 is applied to a bight control circuit 120 via a multiplexor 118. Thus, the feed control circuit 116 controls the previously indicated feed control motor 122 to effect controlled feeding movements of the feed dogs 80, while the bight control circuit 120 controls the previously indicated bight control motor 124 to effect controlled lateral jogging movements of the needle 46. In this manner, successive stitches are formed in the pattern selected by the pattern select switch 24.

The tracing-mode select switch 26 is connected to the analog switch 110 and the multiplexor 118. With the select switch 26 activated, the timing pulse generator 108 applies to the stitch data generator 102 the second timing pulse FCP in place of the first timing pulse BCP, and the multiplexor 118 applies to the bight control circuit 120 a tracing bight signal HS from a tracing control device 130, rather than an output signal (i.e., adjusted bight data described above).

The tracing control device 130 comprises the previously described sensor 54, and a variable resistor 132 which produces a reference signal. The sliding contact of the variable resistor 132 is movable as the width setting member 28 is operated. Outputs of the sensor 54 and the variable resistor 132 are applied to a comparator 134, which in turn generates an output corresponding to a difference between the outputs of the sensor 54 and the resistor 132. The output of the comparator 134 is applied to an adder 138 via an A/D converter 136. The adder 138 is adapted to add the digital output of the A/D converter 136 to a digital output of a latch 140, each time the adder 138 receives the first timing pulse BCP from the timing pulse generator 108 via an OR gate 142. The first timing pulse BCP is also applied to the latch 140 via a one-shot multivibrator 144, with a time delay. The latch 140 holds the output of the adder 138, according to the thus delayed first timing pulse.

The timing pulse generator 108 generates the first and second timing pulses BCP, FCP only while the needle bar 44 is endwise reciprocating with the needle drive motor kept operated. A clock generator 146 is provided so as to supply the adder 138 and the latch 140 with a clock pulse similar to the first timing pulse BCP, even while the sewing machine is at rest. The clock pulse from the clock generator 146 is applied to an input of an AND gate 148 which also receives a NEEDLE-UP signal produced while the needle 46 is placed at its elevated position, and a MACHINE STOP signal produced while the needle drive motor is at rest. Therefore, the clock pulse from the generator 146 is fed from the AND gate 148 to the adder 138 and latch 140 via the OR gate 142, only when the NEED-UP and MACHINE STOP signals are both present.

The bight data HDS generated from the stitch data generator 102 is applied also to a sensor-positioning device 150, in order to control the position of the sensor 54. The sensor-positioning device 150 has a D/A converter 152 which receives the digital bight data HDS and applies the corresponding analog signal to a voltage divider 154. The voltage divider 154 generates a sensor-positioning voltage signal KAS which is a one-third fraction of the input voltage. The sensor-positioning signal KAS is applied to a comparator 156, which also receives a sensor-position signal KES generated by the previously indicated position detector 70 built in the sensor-positioning motor 68. The comparator 156 generates an output signal MS which corresponds to a difference between the two input signals KAS and KES. The output signal MS is applied to a motor control circuit 158, to control the sensor-positioning motor 68 such that the level of the output signal MS is zeroed.

In the tracing mode of operation on the zigzag sewing machine, the operator first sets the work fabric 84 on the upper surface of the bed 10, such that a line of stitches to be formed along the fabric edge is substantially aligned with the center of the elongate needle hole 86 formed in the throat plate 78. Then, the operator activates the tracing-mode select switch 26. As a result, the analog switch 110 is switched to a position for generating the second timing pulse FCP, whereby the second timing pulse FCP rather than the first timing pulse BCP is applied to the stitch data generator 102. Simultaneously, the multiplexor 118 is switched to a position for applying the tracing bight signal HS to the bight control circuit 120.

Figure 9:
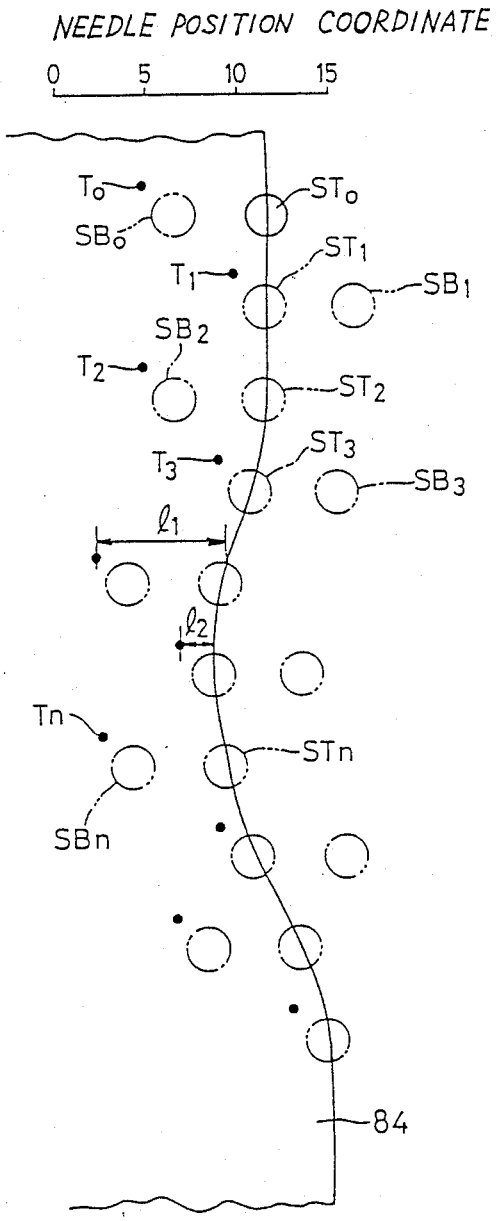
FIG. 9 is a view depicting paths taken by the needle and a photoelectric cell of the fabric sensor, when the zigzag stitches are formed on a work fabric.

When the operator selects a zigzag stitch pattern by manipulating the pattern select switch 24, the pattern select counter 100 applies its count corresponding to the selected zigzag stitch pattern, to the stitch pattern generator 108. Since the needle drive motor has not been started in this condition, the timing pulse generator 102 do not generate the first and second timing pulses BCP, FCP. Accordingly, the stitch data generator 102 generates the bight data HDS representative of a needle position coordinate (0) of stitch number (0) as indicated in FIGS. 8 and 9. The bight data HDS is applied to the voltage divider 154 via the D/A converter 152, whereby the corresponding sensor-positioning signal KAS is applied to the comparator 156. The comparator 156 compares the received sensor-positioning signal KAS with the concurrently received sensor-position signal KES which represents the current position of the sensor 54 relative to the needle bar 44. The output signal MS representative of a difference between the two input signals KAS and KES is fed to the motor control circuit 158. The sensor-positioning motor 68 is controlled by the motor control circuit 158, such that the level of the output signal MS of the comparator 156 is zeroed. As a result, the sensor 54 on the second slide 52 is moved relative to the needle bar 44 and the needle-bar oscillator 38, to a position represented by the sensor-positioning signal KAS, or until the level of the sensor-position signal KES coincides with the sensor-positioning signal KAS.

In this condition, the sensor 54 applies to the comparator 134 its output detection signal KS corresponding to the surface area of the detection area on the concave reflector surface 88, which is not covered by the work fabric 84. The comparator 134 compares this detection signal KS with the reference signal from the variable resistor 132, and applies to the A/D converter 136 an analog error signal which corresponds to the difference between the detection signal KS and the reference signal. The analog error signal is converted by the A/D converter 136 into the corresponding digital signal, which is applied to the adder 138.

In this state, the needle drive motor is still held at rest, and the needle 46 is placed at its elevated position. Namely, the MACHINE STOP and NEEDLE-UP signals are received by the AND gate 148, whereby the clock pulse generated by the clock generator 146 is passed through the OR gate 142 and applied to the adder 138. Upon reception of the clock pulse, the adder 138 operates to add the digital signal from the A/D converter 136 to the signal from the latch 140. The sum obtained by the adder 138 is latched in the latch 140, after a predetermined very short time.

The digital signal latched in the latch 140 is applied as the tracing bight signal HS to the bight control circuit 120 via the multiplexor 118. The bight control circuit 120 controls the bight control motor 124 by an amount determined by the tracing bight signal HS, in the direction determined by the same signal HS. Consequently, the needle-bar oscillator 38 is jogged in the lateral direction substantially perpendicular to the feed direction of the work fabric 84, until the sensor 54 carried by the oscillator 38 has been moved to a position at which the detection signal KS thereof coincides with the reference signal from the variable resistor 132.

The frequency of the clock pulse generated by the clock generator 146 is determined so as to permit the oscillator 38 to complete its movement to its lateral position at which the detection and reference signals coincide with each other, during a time period between the moments when two successive clock pulses are generated. As a result of the coincidence of the detection signal KS with the reference signal, the error signal produced as the output of the comparator 134 is zeroed, and the digital signal from the A/D converter 136 to be added to the adder 138 is also zeroed. Therefore, the output of the adder 138 obtained by addition of the digital signals upon reception of the next clock pulse is equal to the value currently maintained in the latch 140. Accordingly, the same value is again latched in the latch 140, after the predetermined short time. That is, the tracing bight signal HS to be applied to the bight control circuit 120 via the multiplexor 118 is unchanged, whereby the bight control motor 124 and the needle-bar oscillator 38 are held at rest.

The lateral position of the needle 46 is changed as the needle-bar oscillator 38 is moved in the lateral direction, whereby the lowered position of the needle 46 in the lateral direction is determined by the magnitude of the reference signal generated by the variable resistor 132. If the currently established lateral position of the needle 46 does not meet a desired distance between the edge of the work fabric 84 and a line of stitches to be formed on the fabric 84, the reference signal of the variable resistor 32 may be changed by operating the operator-controlled width setting member 28 previously described. With the reference signal changed, the same operation as described above is performed to change the lateral position of the needle-bar oscillator 38, and consequently the lateral position of the needle 46 at its lowered position is varied. The manipulation of the width setting member 28 by the operator is stopped at the moment when the lateral position of the needle 46 lies on the desired line of stitches to be formed on the fabric 84. The following description of the zigzag stitch forming operation is based on an assumption that the needle 46 is located at position $T_o$ corresponding to needle position coordinate (5), while the photoelectric cell 74 is aligned with position ST0, as indicated in FIG. 9. In this condition, the operator activates the main switch 20 to start the needle drive motor. As a result, the needle 46 is lowered to form a first stitch at position T0. As the needle 46 is lowered, the second timing pulse FCP is generated as indicated in FIG. 6. In response to this second timing pulse FCP, the stitch data generator 102 generates stitch data corresponding to stitch number (1). The bight data HDS of the generated stitch data, which represents the needle position coordinate (15) of the stitch number (1), is fed via the D/A converter 152 and the voltage divider 154, to the comparator 156 as the sensor-positioning signal KAS which is the one-third fraction of the voltage input to the divider 154. At this time, the level of the sensor-position signal KES representative of the lateral position of the sensor 54 corresponds to the needle position coordinate (0) of the stitch number (0). The output signal MS representative of the difference between the signals KAS and KES is applied to the motor control circuit 158, whereby the sensor-positioning motor 68 is operated so as to zero the level of the output signal MS. Accordingly, the feed-screw 66 is rotated, and the sensor 54 is moved in the lateral direction of the needle 46. As a result, the photoelectric cell 74 is moved to position SB0 which corresponds to the needle position coordinate (15) of the stitch number (1).

Since the amount of the light received by the photoelectric cell 74 decreases due to the movement of the cell 74, the tracing control device 130 operates upon generation of the first timing pulse BCP, to supply the bight control circuit 120 with the tracing bight signal HS via the multiplexor 118, so as to increase the amount of the light received by the photoelectric cell 74. The bight control circuit 120 controls the bight control motor 124, according to the tracing bight signal HS, whereby the needle-bar oscillator 38 and the needle bar 44 are laterally moved. As the needle bar 44 is moved, the first slide 50 is moved in the lateral direction, so that the photoelectric cell 74 is moved to position ST1, and the needle 46 is moved to position T1 at which a second stitch is formed. At the same time, the work fabric 84 is fed at a rate determined by the feed data NDS from the stitch data generator 102 and by the feed adjusting signal from the feed adjusting circuit 112, as in an ordinary sewing operation.

When the needle 46 is lowered to form the stitch at position T1, the second timing pulse FCP is again generated. In response to this timing pulse FCP, the stitch data generator 102 generates stitch data which includes the bight data HDS corresponding to the needle position coordinate (0) of stitch number (2). The bight data HDS is applied to the sensor-positioning device 150, whereby the sensor 54 is moved so that the photoelectric cell 74 is moved to position SB1.

Since the amount of the light received by the photoelectric cell 74 increases due to the movement of the sensor 54, the tracing control device 130 applies the tracing bight signal HS to the bight control circuit 120 via the multiplexor 118, in response to the first timing pulse BCP, so that the amount of the light received by the pulse BCP, so that the amount of the light received by the photoelectric cell 74 is reduced. The bight control circuit 120 operates the bight control motor 124 according to the tracing bight signal HS, so as to oscillate the needle bar 44. As a result, the needle bar 44 is moved to position T2, while the photoelectric cell 74 is moved to position ST2. A third stitch is formed at position T2.

During the sewing operation with the work fabric 84 automatically fed to form a line of zigzag stitches, the operator handles the work fabric 84 so as to hold the desired distance between the fabric edge and the intended line of stitches to be formed along the edge. Nevertheless, it is more or less inevitable that the stitches are formed off the intended line. Sometimes, the fabric edge itself is curved. FIG. 9 shows that the fabric edge is curved at a portion of the fabric 84 on one side of the position T2 nearer to the operator. In such cases, the detection signal KS generated by the sensor 54 becomes different from the reference signal generated by the variable resistor 132. In consequence, the error signal representative of the difference is fed from the comparator 134 and applied to the adder 138 after it is converted into a digital signal by the converter 136. During the sewing operation, the first timing place BCP generated by the timing pulse generator 108 is applied through the OR gate 142 to the adder 138. In response to this timing pulse BCP, the adder 138 operates to add the digital signal from the A/D converter 136, to the digital signal from the latch 140. Subsequently, the bight control motor 120 is controlled in the same manner as performed when the width setting member 28 is operated while the machine is at rest. Namely, needle-bar oscillator 38 is laterally moved until the detection signal KS from the sensor 54 coincides with the reference signal from the variable resistor 132. Thus, the lateral positions of the needle-bar oscillator 38 and the needle 46 are changed so as to establish the predetermined distance between the fabric edge and the line of stitches to be formed.

With the above-described operations repeated, the distance between the needle 46 and the photoelectric cell 74 as viewed in the plane of FIG. 9 is alternately changed between l1 and l2, according to the bight data HDS, as indicated in FIG. 9. Further, the position of the photoelectric cell 74 is changed according to the tracing bight signal HS, as indicated at ST0, ST1, . . . STn, so as to follow the edge of the work fabric 84, whereby the zigzag stitches are formed on a line which is away from the fabric edge by the predetermined constant distance.

As described above, the concave reflecting surface 88 is formed as a part of the circumferential surface of a cylinder whose centerline extends horizontally in the direction substantially perpendicular to the fabric feeding direction and passes the sensor 54. According to this arrangement, the radiation emitted by the light emitter 72 is reflected by the concave reflecting surface 88, toward the photoelectric cell 74, so that the fabric edge can be detected over a comparatively wide area as viewed in the fabric feeding direction. Consequently, unwoven threads or fibers or tacking pins near the fabric edge would not significantly reduce the amount of the radiation received by the photoelectric cell 74, thereby avoiding a sharp bend of the stitching line.

A further advantage of the present embodiment lies in that the guide rods 58 permit the first slide 50 supporting the sensor 54, to be moved in the lateral direction of the needle 46 when the needle-bar oscillator 8 is pivoted about the shaft 36. This arrangement prevents dislocation of the sensor 54 in the fabric feeding direction, and thus avoids otherwise possible detecting error of the sensor 54.

Figure 11:
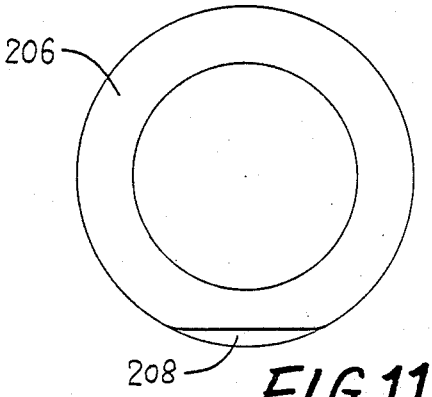
FIGS. 11 and 12 are front and side elevational views, respectively, for explaining the embodiment of FIG. . 10.
Figure 12:
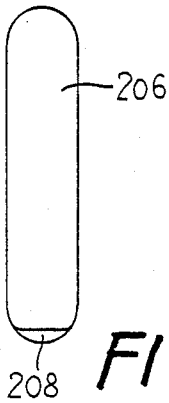
Figure 10:
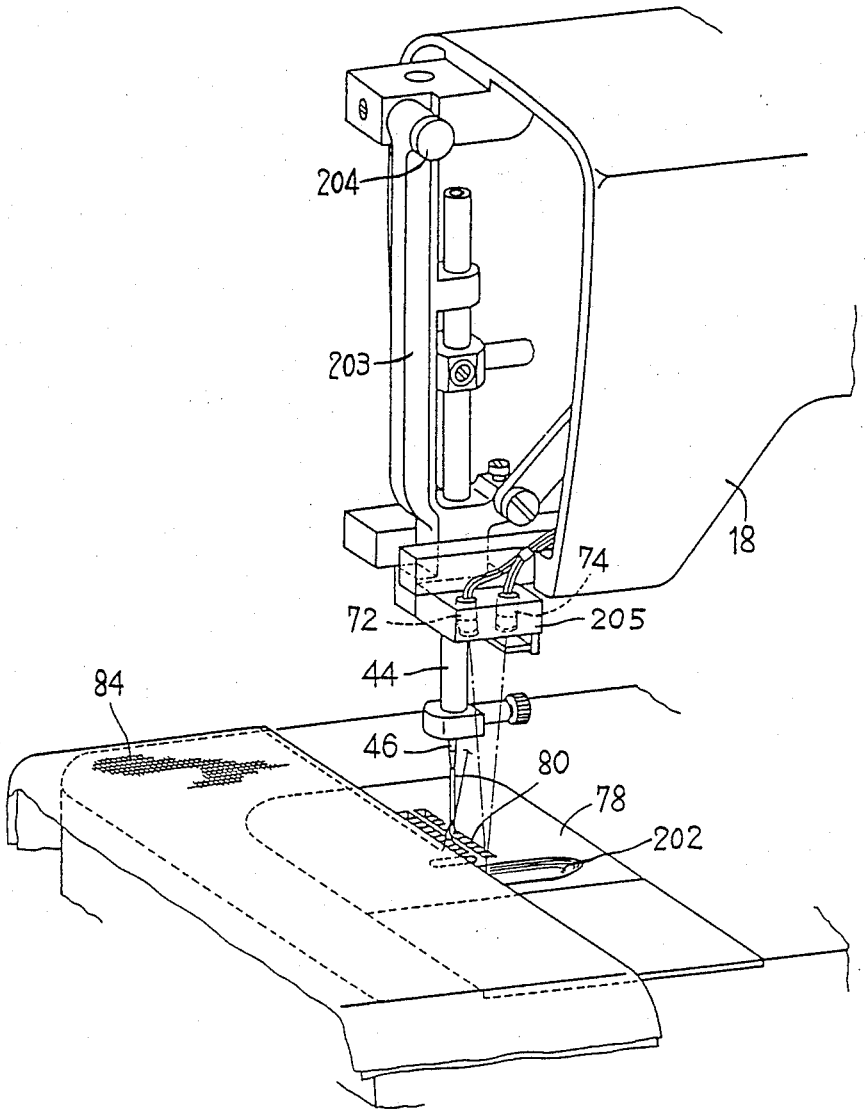
FIG. 10 is a perspective view corresponding to that of FIG. 2, showing another embodiment of the invention.

While the reflecting surface 88 provided in the above embodiment is formed as a part of the circumferential surface of the cylinder whose centerline extends horizontally and passes the sensor 54, the reflecting surface 88 may preferably be replaced by a reflecting surface 202 as shown in FIG. 10, which is concaved in the lateral direction of the needle 46 as well as in the fabric feeding direction, if the needle bar 44 supporting the needle 46 is fixed to a needle-bar oscillator 203 of a type as shown in FIG. 10. Namely, the needle-bar oscillator 203 is supported pivotally about an axis 204 which horizontally extends in the fabric feeding direction, so that the needle 6 and a sensor 205 having the light emitter and photoelectric cell 72, 74 are laterally jogged together with the oscillator 203. In this case, the reflecting surface 202 is formed as a part 208 of an outer surface of a torus or anchor ring 206 as indicated in FIGS. 11 and 12. The torus 206 is obtained by rotating a circle about the pivot axis 204 of the needle-bar oscillator 202, the circle having a center on a horizontal straight line which extends in the lateral direction of the needle 46 and passes the sensor 205. According to the instant arrangement, the detection of the fabric edge by the sensor 205 will not be affected by a change in the posture of the photoelectric cell 74 which takes place when the needle 46 is laterally jogged following a varying position of the fabric edge. That is, the instant arrangement makes it possible to exactly maintain a predetermined constant distance between the fabric edge and a line of stitches to be formed, even if the fabric edge position is varied to a relatively large extent. Further, since the reflecting surface 202 has a concave shape in cross section as viewed in a plane parallel to the fabric feeding direction, the radiation reflected by a comparatively large area of the reflecting surface 202 as viewed in the fabric feeding direction can be received by the photoelectric cell 74 of the sensor 205. Accordingly, unwoven threads or fibers of the work fabric 84 would not cause a sharp bend of the stitching line due to the presence of unwoven threads or fibers of the work fabric 84.

Figure 14:
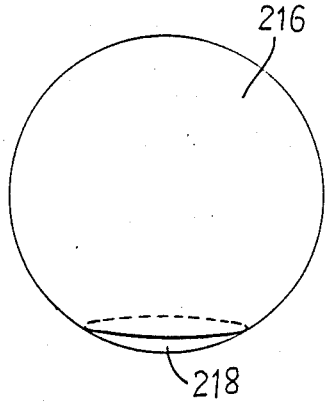
FIGS. 13 and 14 are views illustrating a further embodiment of the invention.
Figure 13:
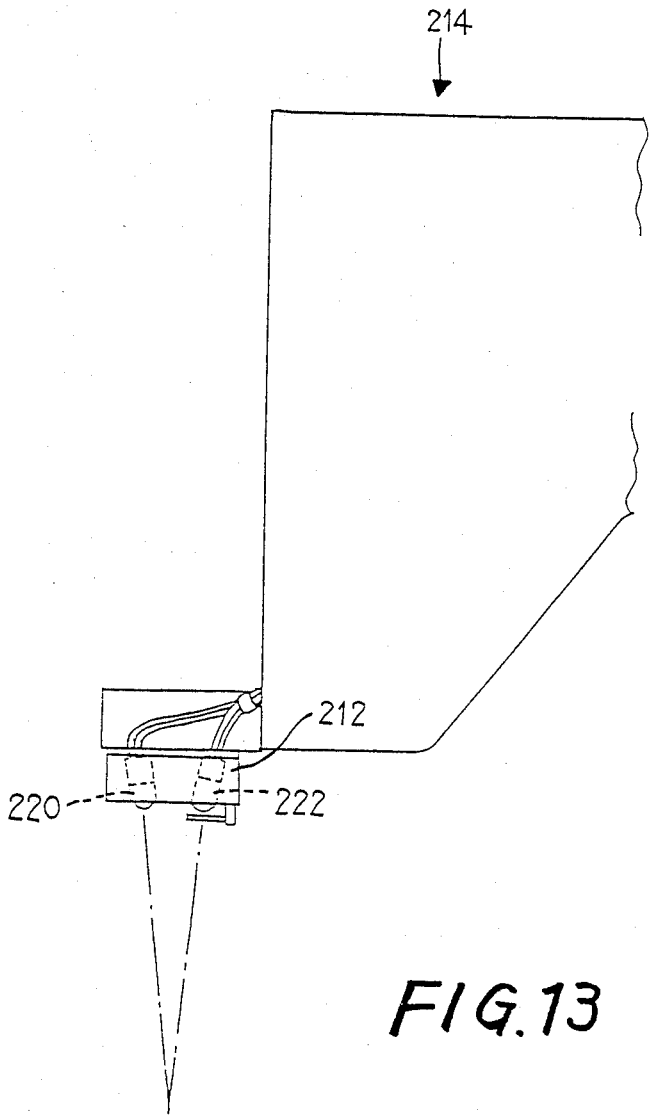

Referring next to FIGS. 13 and 14, there are shown a further modified embodiment of the invention, wherein a sensor 212 having a light emitter 220 and a photoelectric cell 222 is secured to a machine frame 214. In this case, it is preferred to use a reflecting surface which constitutes a part 218 of the surface of a sphere 216 as indicated in FIG. 14, irrespective of whether the pivot axis of the needle-bar oscillator extends horizontally or vertically. If the light emitter 220 and the photoelectric cell 222 are spaced apart from each other by a small distance in the lateral direction of the needle, the sphere 216 has a center at an intermediate point between the light emitter 220 and the photoelectric cell 222. The sensor 212 may be modified such that its light emitter and photoelectric cell are disposed in concentric relation with each other. In this instance, the sphere 216 has a center at the center of the sensor. Since the part-spherical surface 218 defines a downwardly convexed shape which in turn defines a reflecting surface that has a convexity in cross section as viewed in any vertical planes. Therefore, such a reflecting surface is capable of reflecting a radiation from the light emitter of the sensor, over a relatively large area thereof as viewed in the fabric feeding direction and in the lateral direction, so that the reflected radiation is incident upon the photoelectric cell of the sensor. Namely, the detecting area of the sensor can be enlarged in both the fabric feeding direction and the lateral direction of the needle. This arrangement therefore permits accurate detection of the fabric edge even where the edge position has a relatively large variation. This is contrary to a conventional arrangement wherein a radiation emitted from a sensor secured to the machine frame is reflected by a flat straight reflecting surface, which may fail to detect the fabric edge if the edge position is considerably varied. In the present modified embodiment, too, the enlarged detecting coverage in the fabric feeding direction minimizes an adverse influence of unwoven threads or fibers of the fabric upon the detecting accuracy of the sensor.

Although the illustrated embodiment of FIGS. 1–9 is adapted such that the sensor 54 is laterally jogged by the sensor-positioning device 150 so as to form zigzag stitches along the fabric edge, the sensor-positioning device 150 may be eliminated if the stitching jog to be performed is limited to a straight stitching operation along the fabric edge. In this instance, the lateral position of the sensor 54 relative to the needle 46 may be changed by the operator by rotating the feed screw 66. Consequently, the feed screw 66 may be used as width setting means, in place of the width setting member 28 and the variable resistor 132.

The principle of the present invention is also applicable to a sewing machine of a type wherein a fabric sensor is laterally moved relative to a machine frame in a manner as disclosed in Japanese Patent Application No. 61-63085. More specifically, when the work fabric is placed on the bed of the machine, the fabric sensor is laterally moved by a servo motor to a position at which the output level of the sensor is equal to a predetermined value (e.g., 50%). Thereafter, the sensor is fixed in position, and the needle-bar oscillator is activated to form stitches along the fabric edge, according to a change in the output level of the sensor due to a variation in the fabric edge position.

While the present invention has been described in its presently preferred embodiments, it is well understood that it is within the skill of the art to make other changes, modifications and improvements in the specific constructions of the fabric sensor 54, 205, 212, tracing control device 130 and sensor-positioning device 150, and in the overall arrangement of the zigzag sewing machine, without departing from the spirit and scope of the invention defined in the following claims.

What is claimed is:

1. A sewing machine having a function of tracing an edge of a workpiece to form a line of stitches along said edge, comprising:

a machine frame;

a work bed on which the workpiece is placed;

an endwise reciprocable needle bar which has a sewing needle fixed at its lower end;

a feed mechanism for feeding the workpiece in a predetermined feeding direction;

a needle-bar oscillator for supporting said needle bar such that the needle bar is endwise reciprocable with said needle, said needle-bar oscillator being disposed on said machine frame, such that the oscillator is joggable in a lateral direction substantially perpendicular to said feeding direction of the workpiece;

a fabric sensor for detecting the edge of the workpiece which extends in said feeding direction, said fabric sensor including a light emitting portion for producing a radiation, and a light receiving portion;

a smooth reflecting surface provided on said work bed, in the vicinity of a lowered position of said needle, for reflecting said radiation toward said light receiving portion of said fabric sensor, said reflecting surface having a concave shape in cross section taken in a vertical plane parallel to said feeding direction; and actuator and control means responsive to said fabric sensor, for effecting a controlled jogging movement of said needle-bar oscillator in said lateral direction, according to an amount of said radiation received by said light receiving portion of said fabric sensor, so that said line of stitches is spaced apart from said edge of the workpiece by a predetermined distance.

2. A sewing machine according to claim 1, wherein said reflecting surface is defined by a part of a cylinder whose centerline extends substantially in said lateral direction.

3. A sewing machine according to claim 1, wherein said fabric sensor engages said needle-bar oscillator such that said fabric sensor is moved in relation to said controlled lateral movement of said needle-bar oscillator, said actuator and control means including a guide member for guiding said fabric sensor, said guide member being fixed to said machine frame so as to extend substantially in said lateral direction.

4. A sewing machine according to claim 2, wherein said fabric sensor engages said needle-bar oscillator such that said fabric sensor is moved in relation to said controlled lateral movement of said needle-bar oscillator, said actuator and control means including a guide member for guiding said fabric sensor, said guide member being fixed to said machine frame so as to extend substantially in said lateral direction.

5. A sewing machine according to claim 1, wherein said reflecting surface is defined by a part of an outer surface of a torus having a center on a straight line which extends substantially in said feeding direction, whereby said reflecting surface has an arcuate shape in cross section taken in both said vertical plane parallel to said feeding direction and another vertical plane parallel to said lateral direction.

6. A sewing machine according to claim 5, wherein said needle-bar oscillator is pivotable substantially about said straight line, and said fabric sensor is supported by said needle-bar oscillator.

7. A sewing machine according to claim 1, wherein said reflecting surface is defined by a part of the surface of a sphere.

8. A sewing machine according to claim 7, wherein said fabric sensor is secured to said machine frame.

9. A sewing machine according to claim 16, wherein said actuator and control means further comprises:

a first guide member supported by said machine frame and extending substantially in said lateral a first slide slidably supported by said first guide member, and engaging said needle-bar oscillator such that said first slide is moved as said needle-bar oscillator is laterally jogged;

a second guide member supported by said first slide and extending substantially in said lateral direction;

a second slide slidably supported by said second guide member, and supporting said fabric sensor; and actuator means for changing a position of said second slide relative to said first slide.

10. A sewing machine according to claim 10, wherein said actuator means includes a feed screw which is rotatably and axially immovably supported by said first slide, and which is threaded to said second slide, said actuator means further includes an electric drive motor for rotating said feed screw.

11. A sewing machine according to claim 11, further comprising detector means for detecting an amount of rotation of said feed screw and thereby detecting a position of said fabric sensor relative to said first slide.

12. A sewing machine having a function of tracing an edge of a workpiece to form a line of stitches along said edge, comprising:

a machine frame;

a work bed on which the workpiece is placed;

an endwise reciprocable needle bar which has a sewing needle fixed at its lower end;

a feed mechanism for feeding the workpiece in a predetermined feeding direction;

an endwise reciprocable needle bar which has a sewing needle fixed at its lower end;

a feed mechanism for feeding the workpiece in a predetermined feeding direction;

a needle-bar oscillator for supporting said needle bar such that the needle bar is endwise reciprocable with said needle, said needle-bar oscillator being disposed on said machine frame, such that the oscillator is joggable in a lateral direction substantially perpendicular to said feeding direction of the workpiece;

a fabric sensor for detecting the edge of the workpiece which extends in said feeding direction, said fabric sensor including a light emitting portion for producing a radiation, and a light receiving portion;

a smooth reflecting surface provided on said work bed, in the vicinity of a lowered position of said needle, for reflecting said radiation toward said light receiving portion of said fabric sensor;

actuator and control means responsive to said fabric sensor, for effecting a controlled jogging movement of said needle-bar oscillator in said lateral direction, according to an amount of said radiation received by said light receiving portion of said fabric sensor, so that said line of stitches is spaced apart from said edge of the workpiece by a predetermined distance;

said fabric sensor engaging said needle-bar oscillator such that said fabric sensor is moved in relation to said controlled lateral movement of said needle-bar oscillator;

said actuator and control means including a guide member for guiding said fabric sensor, said guide member being fixed to said machine frame so as to extend substantially in said lateral direction, said actuator and control means further including a movable member which is movably supported by said guide member and which engages said needle-bar oscillator such that said movable member is moved in said lateral direction as said needle-bar oscillator is laterally jogged, said fabric sensor being mounted on said movable member.

13. A sewing machine having a function of tracing an edge of a workpiece to form a line of stitches along said edge, comprising:

a machine frame;

a work bed on which the workpiece is placed;

an endwise reciprocable needle bar which has a sewing needle fixed at its lower end;

a feed mechanism for feeding the workpiece in a predetermined feeding direction;

a needle-bar oscillator for supporting for supporting said needle bar such that the needle bar is endwise reciprocable with said needle, said needle-bar oscillator being disposed on said machine frame, such that the oscillator is joggable in a lateral direction substantially perpendicular to said feeding direction of the workpiece;

a fabric sensor for detecting the edge of the workpiece which extends in said feeding direction, said fabric sensor including a light emitting portion for producing a radiation, and a light receiving portion;

a smooth reflecting surface provided on said work bed, in the vicinity of a lowered position of said needle, for reflecting said radiation toward said light receiving portion of said fabric sensor; and actuator and control means responsive to said fabric sensor, for effecting a controlled jogging movement of said needle-bar oscillator in said lateral direction, according to an amount of said radiation received by said light receiving portion of said fabric sensor, so that said line of stitches is spaced apart from said edge of the workpiece by a predetermined distance, said actuator and control means comprising first positioning means for changing a relative position between said needle-bar oscillator and said fabric sensor, so as to establish a selected relative position between said fabric sensor and said needle in said lateral direction, and further comprising second positioning means for positioning said needle-bar oscillator and said fabric sensor in response to a variation in the position of said edge of the workpiece in said lateral direction, while maintaining the relative position between said oscillator and said sensor, so that said amount of the radiation received by said light receiving portion of the fabric sensor is maintained at a predetermined value.

14. A sewing machine according to claim 13, wherein said reflecting surface has a concave shape in cross-section taken in a vertical plane parallel to said feeding direction.

15. A sewing machine a function of tracing an edge of a workpiece to form a line of stitches along said edge, comprising:

a machine frame;

a work bed on which the workpiece is placed;

an endwise reciprocable needle bar which has a sewing needle fixed at a lower end;

a feed mechanism for feeding the workpiece in a predetermined feeding direction;

a needle-bar oscillator for supporting said needle bar such that the needle bar is endwise reciprocable with said needle, said needle-bar oscillator being disposed on said machine frame, such that the oscillator is joggable in a lateral direction substantially perpendicular to said feeding direction of the workpiece;

a fabric sensor for detecting the edge of a workpiece which extends in said feeding direction, said fabric sensor including a light emitting portion for producing a radiation, and a light receiving portion;

a smooth reflecting surface provided on said work bed, in the vicinity of a lowered position of said needle, for reflecting said radiation toward said light receiving portion of said fabric sensor;

actuator and control means responsive to said fabric sensor, for effecting a controlled jogging movement of said needle-bar oscillator in said lateral direction, according to an amount of said radiation received by said light receiving portion of said fabric sensor, so that said line of stitches is spaced apart from said edge of the workpiece by a predetermined distance;

said fabric sensor engaging said needle-bar oscillator such that said fabric sensor is moved in relation to said controlled lateral movement of said needle-bar oscillator;

said actuator and control means including a guide member for guiding said fabric sensor, said guide member being fixed to said machine frame so as to extend substantially in said lateral direction; and said actuator and control means further including a first positioning means for changing a relative position between said needle-bar oscillator and said fabric sensor, so as to establish a selected relative position between said fabric sensor and said needle in said lateral direction, and second positioning means for positioning said needle-bar oscillator and said fabric sensor in response to a variation in the position of said edge of the workpiece in said lateral direction, while maintaining the relative position between said oscillator and said sensor, so that said amount of the radiation received by said light receiving portion of the fabric sensor is maintained at a predetermined value.

16. A sewing machine according to claim 18, wherein said actuator and control means further comprises:

a first slide slidably supported by said guide member, and engaging said needle-bar oscillator such that said first slide is moved as said needle-bar oscillator is laterally jogged;

another guide member supported by said first slide and extending substantially in said lateral direction;

a second slide slidably supported by said another guide member, and supporting said fabric sensor; and actuator means for changing a position of said second slide relative to said first slide.

* * * * *